US010288024B2

(12) United States Patent
Marsden et al.

(10) Patent No.: US 10,288,024 B2
(45) Date of Patent: May 14, 2019

(54) HIGH PRESSURE FUEL PUMP

(71) Applicant: DELPHI TECHNOLOGIES IP LIMITED, St. Michael (BB)

(72) Inventors: Ben Marsden, Hanwell (GB); Andreas Panayiotou, Upper Demonton (GB); Adam Mercer, Brockworth (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 302 days.

(21) Appl. No.: 15/118,602

(22) PCT Filed: Jan. 13, 2015

(86) PCT No.: PCT/EP2015/050444
§ 371 (c)(1),
(2) Date: Aug. 12, 2016

(87) PCT Pub. No.: WO2015/121010
PCT Pub. Date: Aug. 20, 2015

(65) Prior Publication Data

US 2017/0058849 A1 Mar. 2, 2017

(30) Foreign Application Priority Data

Feb. 13, 2014 (GB) ..... 1402528.2

(51) Int. Cl.
*F02M 59/44* (2006.01)
*F04B 19/22* (2006.01)
(Continued)

(52) U.S. Cl.
CPC ..... *F02M 59/442* (2013.01); *F02M 61/167* (2013.01); *F04B 19/22* (2013.01); *F04B 39/0005* (2013.01)

(58) Field of Classification Search
CPC .... F02M 59/442; F02M 61/167; F04B 19/22; F04B 39/0005
(Continued)

(56) References Cited

U.S. PATENT DOCUMENTS 3,099,217 A 7/1963 Bessiere
4,082,072 A * 4/1978 Johnson ..... F02M 59/44 123/495
(Continued)

FOREIGN PATENT DOCUMENTS

DE 10 2004 063074 A1 7/2006
DE 10 2008 000955 A1 10/2009
(Continued)

OTHER PUBLICATIONS

English Translation of JP 2010229898 (Retrieved from <URL: https://worldwide.espacenet.com/> on Jul. 23, 2018. Translation to English by EPO and Google.).*
(Continued)

*Primary Examiner* — Thomas E Lazo
*Assistant Examiner* — Richard C Drake
(74) *Attorney, Agent, or Firm* — Joshua M. Haines

(57) ABSTRACT

A fuel pump includes a housing provided with an axial bore defining a compression chamber. The pump is further provided with a cylindrical piston slidably arranged in the bore, the piston extending from a top extremity that is inside the bore, defining a high pressure extremity, to a lower extremity, defining a low pressure extremity. The piston is able to reciprocally slide between a lower position where fuel at low pressure enters the compression chamber via an inlet and, a top position where fuel present in the compression chamber is pressurized before being expelled via an outlet. The piston is also provided with a recess surrounded by a peripheral wall arranged on its high pressure extremity, the recess and
(Continued)

peripheral wall enabling the piston to expand radially when fuel in the compression chamber is pressurized.

5 Claims, 2 Drawing Sheets

(51) Int. Cl.
*F04B 39/00* (2006.01)
*F02M 61/16* (2006.01)

(58) Field of Classification Search
USPC ..... 92/172
See application file for complete search history.

(56) References Cited

U.S. PATENT DOCUMENTS 4,540,352 A * 9/1985 Becker ..... F04B 53/143 417/571
4,730,550 A * 3/1988 Bramstedt ..... F04B 39/042 137/521
5,899,136 A * 5/1999 Tarr ..... F02M 59/442 123/495
7,547,201 B2 * 6/2009 Chou ..... B29C 73/166 277/438
2003/0116640 A1 * 6/2003 Mattes ..... F02M 47/027 239/88
2008/0224417 A1 * 9/2008 Benson ..... F02M 59/02 277/411
2009/0126690 A1 * 5/2009 Garland ..... F02M 59/02 123/456
2009/0288639 A1 * 11/2009 Usui ..... F02M 55/04 123/457
2012/0199103 A1 * 8/2012 Hashida ..... F02M 59/102 123/508
2013/0323103 A1 * 12/2013 Shreve ..... F04B 1/0448 417/437
2014/0102417 A1 * 4/2014 Rosu ..... F02M 59/102 123/507

FOREIGN PATENT DOCUMENTS

DE 10 2008 040088 A1 1/2010
DE 10 2008 041176 A1 2/2010
GB 2303411 A 2/1997
JP H08 177728 A1 7/1996
JP 2010 229898 A1 10/2010
JP 2010 229924 A1 10/2010
JP 2010229924 A 10/2010

OTHER PUBLICATIONS

English translation of DE 102008041176 (Retrieved from <URL:http://patentscope.wipo.int/> on Jul. 23, 2018. Translation to english provided by WIPO).*
EP International Search Report dated Mar. 13, 2015.

* cited by examiner

P.T.

HIGH PRESSURE FUEL PUMP

CROSS REFERENCE TO RELATED APPLICATIONS

This application is a national stage application under 35 USC 371 of PCT Application No. PCT/EP2015/050444 having an international filing date of Jan. 13, 2015, which is designated in the United States and which claimed the benefit of GB Patent Application No. 1402528.2 filed on Feb. 13, 2014 the entire disclosures of each are hereby incorporated by reference in their entirety.

TECHNICAL FIELD

The present invention relates to a high pressure fuel pump and more particularly to a dilation arrangement of the piston of the pump.

BACKGROUND OF THE INVENTION

High pressure fuel pumps known in the art have a housing provided with a bore defining a compression chamber and, a cylindrical piston reciprocally translating within the bore so that fuel in the compression chamber is pressurized. While the majority of the pressurized fuel exits via an outlet orifice, a small quantity of pressurized fuel leaks through the functional clearance that is between the bore and the piston. In operation, when fuel is under high pressure, the clearance increases allowing more important fuel leak.

SUMMARY OF THE INVENTION

Accordingly, it is an object of the present invention to solve the above mentioned problem in providing a fuel pump of a fuel injection equipment of an internal combustion engine. The pump has a housing provided with an axial bore defining a compression chamber and a cylindrical piston slidably arranged in the bore. The piston extends from a top extremity inside the bore, defining a high pressure extremity, to a lower extremity, defining a low pressure extremity. The piston is able to reciprocally slide between a lower position where fuel at low pressure enters the compression chamber via an inlet and, a top position where fuel present in the compression chamber is pressurized before being expelled via an outlet.

The piston is further provided with dilation mean arranged on its high pressure extremity, said mean enabling the piston to expand radially when fuel in the compression chamber is pressurized. This dilation mean advantageously limits the clearance between the piston and the bore.

In an embodiment, the dilation mean is a recess provided on the top face of the piston and surrounded by a peripheral wall integral to the piston.

More specifically, the recess defines a cylindrical volume.

In an alternative embodiment, the dilation mean is a circular groove extending from the top face of the piston, the circular groove being surrounded by a peripheral wall integral to the piston.

The dilation mean further comprises a pressure drop feature enabling pressurized fuel to drop in pressure and to flow toward a low pressure circuit. The location of said feature limits the portion of the piston that expands under fuel pressure.

The pressure drop feature comprises a groove ring arranged on the outer cylindrical face of the peripheral wall and a fuel path extending from said groove ring toward the low pressure circuit. The fuel path may comprise a flat arranged on the outer cylindrical face of the piston, said flat axially extending to the lower end of the piston.

In another alternative, the diameter of the piston is larger above the groove ring than below the groove ring so that the clearance between the piston and the bore is largely increased below the groove. This difference in diameter creates an annular volume that is the fuel path wherein pressurized fuel in the groove flows toward the low pressure circuit.

BRIEF DESCRIPTION OF THE DRAWINGS

The present invention is now described by way of example with reference to the accompanying drawings in which.

DESCRIPTION OF THE PREFERRED EMBODIMENTS

In the following description, similar elements will be designated with the same reference numbers. Also, to ease and clarify the description a top-down orientation will be followed in reference to the orientation of the figures. Therefore, words and expressions such as "top, upper, lower, over, under" . . . may be utilized without any intention to limit the scope of the invention.

Figure 1:
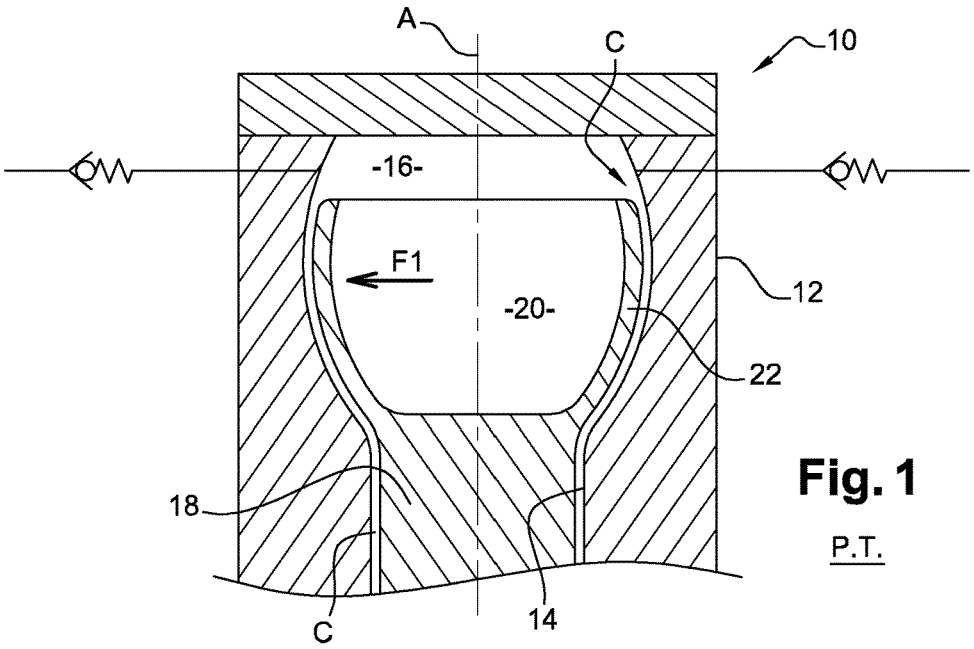
FIG. 1 is a schematic axial section of a pump as per a main embodiment of the invention.

A main embodiment is now described in reference to FIG. 1 where an axial section of a high pressure pump 10 is schematically represented. The pump 10 has a housing 12 in which is provided a bore 14 extending along a main axis A from a top end, defining a compression chamber 16, to a lower end, not represented, opening outside the housing 12. Inside the bore 14 is slidably arranged a piston 18. A functional clearance C is maintained between the inner cylindrical face of the bore 14 and the outer cylindrical face of the piston 18 enabling displacement of the piston. 18. The pump 10 is further provided with non-represented controlled inlet and outlet enabling fuel to flow in and out the compression chamber 16.

In the main embodiment of FIG. 1, the piston 18 is provided with a top cylindrical recess 20 upwardly opening in the compression chamber 16. The recess 20 is surrounded by a peripheral wall 22 integral to the piston 18 and, the volume of the compression chamber 16 of this first embodiment comprises the volume of the bore 14 that is above the piston 18 to which is added the volume of the recess 20.

Figure 2:
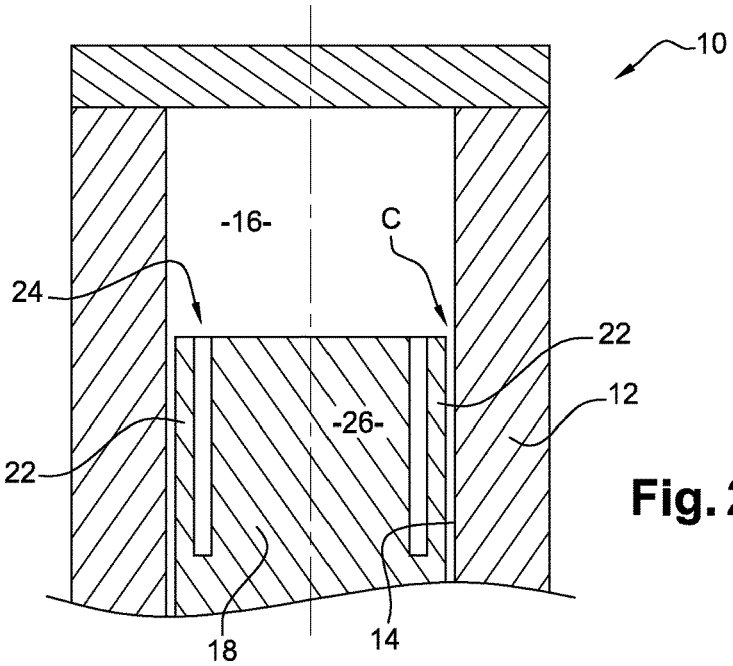
FIG. 2 is a schematic axial section of an alternative embodiment of a pump of the invention.
Figure 3:
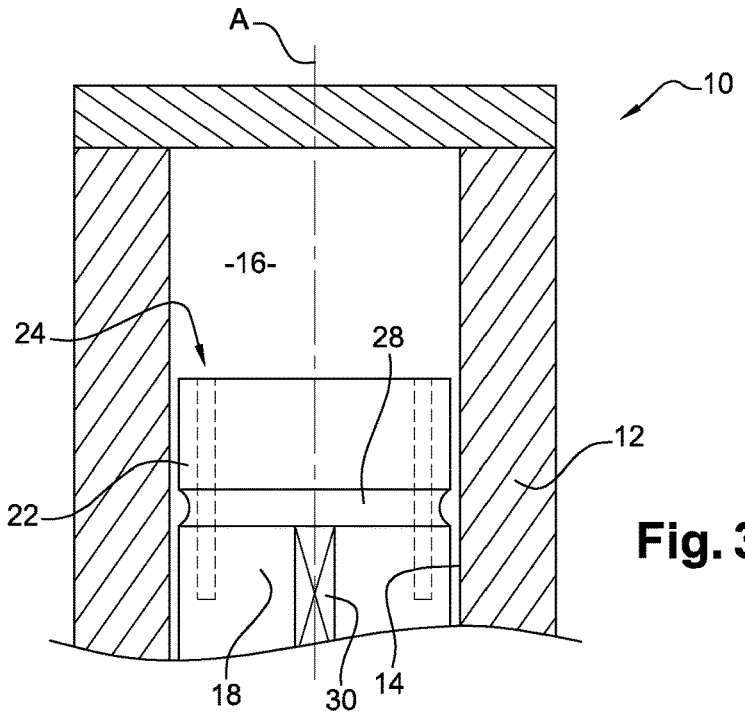
FIG. 3 is a schematic axial section of yet another alternative embodiment of a pump of the invention.

In operation the piston 18 is actuated by a non-represented rotating cam that reciprocally displaces the piston 18 between a top position PT, FIG. 1, and a low position PL, FIGS. 2 and 3. The fuel can be pressurized at several thousand bars that generate dilation of the pump constituents. The top part of the housing 12 expends and has the tendency to open-up the upper end of the functional clearance C. The pressurized fuel inside the recess 20 generates outwardly oriented radial forces F1 on the peripheral wall 22 that creates radial expansion of the peripheral wall 22. This expansion compensates the dilation of the bore 14 and avoids the opening of the functional clearance C. The pressurized fuel entering the functional clearance C generates on the peripheral wall 22 inwardly oriented forces F2, opposed in direction of the outward forces F1, whose intensity decreases as being more distant from the compression chamber 16.

The deformation of the peripheral wall 22 is a consequence of the outwardly oriented forces F1 and of the inwardly oriented F2. The skilled person will understand that the barrel-type expansion of the peripheral 22, as represented on FIG. 1, is a non-limiting exaggerated illustration.

An alternative to the main embodiment is now described in reference to FIG. 2, by ways of differences with the main embodiment of FIG. 1. In said alternative, the recess 20 is limited to a deep circular groove 24 axially extending from the top of the piston 18 and upwardly opening in the compression chamber 16. As visible on FIG. 2, the peripheral wall 22 is identical as in the main embodiment. It externally surrounds the deep circular groove 24 and, inwardly, the circular groove 24 is bordered by an inner cylindrical core 26 that fills the majority of the volume of the recess 20 of the main embodiment. Therefore, in this alternative, the volume increase of the compression chamber 16 is limited to the volume of the circular groove 24.

In operation, the pressure inside the groove 24 generates on the peripheral wall 22 the same outwardly oriented radial forces FR generating similar expansion as in the main embodiment and also, generates inwardly oriented radial forces on the inner cylindrical core, said inward forces not generating any noticeable deformation of the inner core.

In this alternative, the opening of the functional clearance C is compensated by the deformation of the peripheral wall 22 without important increase of the volume of the compression chamber 16.

In non-represented further alternatives, the inner core 26 could be non-integral to the piston 18 and fixed inside the recess 20. Also, the recess 20 of the main embodiment is described as a cylindrical volume but, other shapes such as a conical recess or, two or more adjacent cylindrical volumes on the top of each other are possible alternatives.

In FIG. 3, the piston 18 is provided with a groove ring 28 arranged on the external face of the peripheral wall 22. From said groove ring 28 downwardly extends a fuel path 30. The purpose of the ring 28 and associated path 30 is to enable a fuel pressure drop, the location of the ring 28 defining where said pressure drop occurs and where to limit the expansion of the peripheral wall 22.

The fuel path 30, as represented on FIG. 3, can be a flat arranged on the outer cylindrical surface of the piston 18, directing the fuel from the annular groove 28 to the back-leak. In this case, the groove ring 28 acts as a pressure relief since the pressurized fuel, entering the functional clearance C, generates inwardly oriented forces F2 from the top of the piston down to the groove 28 only. When arriving at the groove 28, the fuel pressure suddenly decreases to a low pressure level generating no deformation of the wall.

Figure 4:
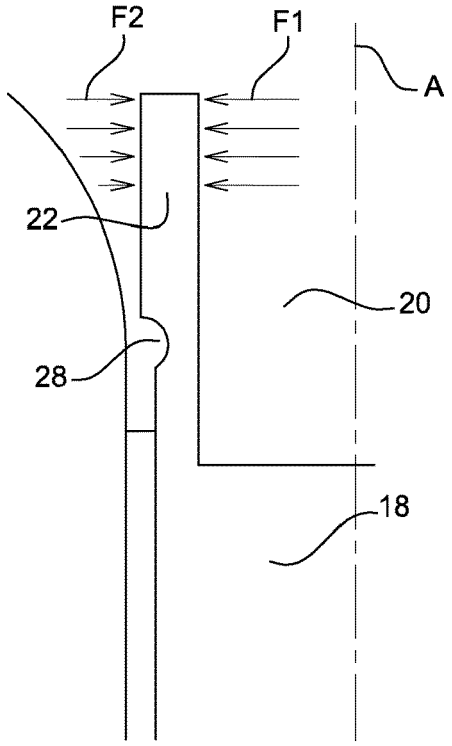
FIG. 4 is a schematic diagram of the radial forces distribution.

An alternative to the passage 30 is represented on FIG. 4 where, instead of a flat wherein can flow fuel, the diameter of the piston 18 below the groove 28 is smaller than the diameter above the groove 28. Therefore the clearance below the groove 28 is larger and it enables fuel flow at low pressure below the groove 28.

The following references have been utilized in this description:

10 pump
12 housing
14 bore
16 compression chamber
18 piston
20 recess
22 peripheral wall
24 circular groove
26 inner cylindrical core
28 groove ring
30 fuel passage
A main axis
C functional clearance
PT top position
PL low position
FR Radial forces

The invention claimed is:

1. A fuel pump of a fuel injection equipment of an internal combustion engine, said fuel pump comprising:

a housing provided with an axial bore defining a compression chamber; and a cylindrical piston slidably arranged in the axial bore, the cylindrical piston extending from a top extremity that is inside the axial bore, defining a high pressure extremity, to a lower extremity, defining a low pressure extremity, the cylindrical piston being able to reciprocally slide between a lower position where fuel at low pressure enters the compression chamber via an inlet and, a top position where fuel present in the compression chamber is pressurized before being expelled via an outlet, wherein the cylindrical piston is provided with a dilation mean arranged on its high pressure extremity, said dilation mean enabling the cylindrical piston to expand radially when fuel in the compression chamber is pressurized;

wherein the dilation mean is a recess provided on a top face of the cylindrical piston, said recess being surrounded by a peripheral wall integral to the cylindrical piston;

wherein the dilation mean further comprises a pressure drop feature enabling pressurized fuel to drop in pressure and to flow toward a low pressure circuit, the location of said pressure drop feature limiting the portion of the cylindrical piston that expands under fuel pressure; and wherein the pressure drop feature comprises a groove ring arranged on the outer cylindrical face of the peripheral wall and a fuel path extending from said groove ring toward the low pressure circuit.

2. A fuel pump as set in claim 1 wherein the recess defines a cylindrical volume.

3. A fuel pump as set in claim 1 wherein said fuel path comprises a flat arranged on the outer cylindrical face of the cylindrical piston.

4. A fuel pump as set in claim 1 wherein the diameter of the cylindrical piston is larger above the groove ring than below the groove ring so that the clearance between the cylindrical piston and the axial bore is increased below the groove ring creating the fuel path wherein pressurized fuel in the groove ring flows toward the low pressure circuit.

5. A fuel pump as set in claim 1 wherein the dilation mean is a circular groove extending from a top face of the cylindrical piston, said circular groove being surrounded by a peripheral wall integral to the cylindrical piston.

* * * * *